US008038808B2

(12) United States Patent
Matsukawa et al.

(10) Patent No.: US 8,038,808 B2
(45) Date of Patent: Oct. 18, 2011

(54) FLAT SOFT MAGNETIC MATERIAL AND PROCESS FOR ITS PRODUCTION

(75) Inventors: Atsuhito Matsukawa, Chuo-ku (JP); Katsuhiko Wakayama, Chuo-ku (JP); Hideharu Moru, Chuo-ku (JP); Naoyoshi Sato, Chuo-ku (JP); Yoshihito Hirai, Chuo-ku (JP); Toshihisa Murayoshi, Chuo-ku (JP)

(73) Assignee: TDK Corporation, Tokyo (JP)

( * ) Notice: Subject to any disclaimer, the term of this patent is extended or adjusted under 35 U.S.C. 154(b) by 275 days.

(21) Appl. No.: 12/426,528

(22) Filed: Apr. 20, 2009

(65) Prior Publication Data

US 2009/0267017 A1 Oct. 29, 2009

(30) Foreign Application Priority Data

Apr. 23, 2008 (JP) ..... P2008-112863

(51) Int. Cl.
*H01F 1/147* (2006.01)
*H01F 1/20* (2006.01)

(52) U.S. Cl. ..... 148/309; 148/310; 148/312; 148/315; 148/104; 148/105; 148/121

(58) Field of Classification Search ..... None
See application file for complete search history.

(56) References Cited

U.S. PATENT DOCUMENTS

| | | | | |
|---|---|---|---|---|
| 7,132,019 | B2 | 11/2006 | Koshiba et al. | |
| 2006/0151068 | A1 | 7/2006 | Lee et al. | |
| 2007/0221297 | A1 * | 9/2007 | Matsukawa et al. | 148/307 |

FOREIGN PATENT DOCUMENTS

| | | |
|---|---|---|
| EP | 0 854 669 | 7/1998 |
| JP | 62-238305 | 10/1987 |
| JP | 1-294802 | 11/1989 |
| JP | 5-98301 | 4/1993 |
| JP | 09-027694 | 1/1997 |
| JP | 2001-303111 | 10/2001 |
| JP | 2003-234594 | 8/2003 |
| JP | 2003-332113 | 11/2003 |
| JP | 2005-123531 | 5/2005 |
| JP | 2005-307291 | 11/2005 |

OTHER PUBLICATIONS

K. Nomura et al., "CEMS Study on Fe-Si-Al Alloy Flakes-Polymer Composites", Hyperfine Interactions 148/149, Kluwer Academic Publishers, 2003, pp. 345-350.

* cited by examiner

*Primary Examiner* — John Sheehan
(74) *Attorney, Agent, or Firm* — Drinker Biddle & Reath LLP

(57) ABSTRACT

A flat soft magnetic material to be used for a noise-suppressing magnetic sheet, wherein the 50% particle size $D_{50}$ (μm), coercive force Hc (A/m) and bulk density BD ($Mg/m^3$) of the flat soft magnetic material satisfy the following formula (1).

$$D_{50}/(HC \times BD) \geqq 1.5 \quad (1)$$

4 Claims, 2 Drawing Sheets

FLAT SOFT MAGNETIC MATERIAL AND PROCESS FOR ITS PRODUCTION

BACKGROUND OF THE INVENTION

1. Field of the Invention

The present invention relates to a flat soft magnetic material to be used in a noise-suppressing magnetic sheet, and to a process for its production.

2. Related Background Art

As the operating speeds of digital circuits have increased in recent years, the electromagnetic noise emitted from circuits has shifted more toward the high-frequency band. Such noise arises from malfunctioning of the devices themselves resulting from internal interference, or malfunctioning of other devices resulting from external interference. Further increased packaging density is also becoming necessary in recent years in order to achieve lighter-weight, thinner and smaller digital circuit-mounted devices. Electromagnetic shielding materials capable of shielding noise continue to be developed, and methods have been proposed wherein noise-suppressing parts comprising sheets of oriented and dispersed soft magnetic materials are placed near electronic circuits that are the sources of noise.

Soft magnetic materials are used in such noise-suppressing sheets, and it is known that a noise-suppressing effect can be achieved in a wide frequency band if the soft magnetic material is thin and flat.

Methods that have been disclosed for fabrication of flat soft magnetic materials include using sendust materials produced by water atomization, as a method for producing flaky or flat Fe—Si—Al alloy powder, in JP No. S62-238305 A (Document 1) and JP No. H1-294802 A (Document 2), for example. Also, JP No. 2003-332113 A (Document 3) and JP No. 2005-123531 A (Document 4) disclose using flat soft magnetic metal powders, or materials produced by gas atomization. In addition, JP No. 2001-303111 A (Document 5) discloses a method in which a fatty acid and an organic solvent such as an alcohol are included during pulverization in the mechanical flat working of a soft magnetic metal powder grinding medium by atomization using a pulverizer. Finally, JP No. H5-98301 A (Document 6) discloses, as an example, flattening treatment of sendust powder produced by water atomization together with ethanol, using an attritor.

SUMMARY OF THE INVENTION

Documents 1, 2, 5 and 6 deal with soft magnetic materials for use in magnetic cards, while Documents 3 and 4 focus on the oxygen contents of the soft magnetic materials. None of the soft magnetic materials produced by the processes described in Documents 1-6 have had high enough magnetic permeability to exhibit sufficient sheet properties when they are used as noise-suppressing magnetic sheets.

It is therefore an object of the present invention to provide a flat soft magnetic material that can be used to form a noise-suppressing magnetic sheet with sufficiently high magnetic permeability, as well as a process for its production.

The invention provides a flat soft magnetic material to be used for a noise-suppressing magnetic sheet, wherein the 50% particle size $D_{50}$ (μm), coercive force Hc (A/m) and bulk density BD ($Mg/m^3$) of the flat soft magnetic material satisfy the following formula (1).

$$D_{50}/(Hc\times BD)\geqq 1.5 \quad (1)$$

By using a flat soft magnetic material satisfying these conditions, it is possible to form a noise-suppressing magnetic sheet with sufficiently high magnetic permeability. The magnetic permeability at high frequency can be represented as the complex magnetic permeability ($\mu=\mu'-j\mu''$) where μ' is the real permeability and μ" is the imaginary permeability. The magnetic shielding effect is dependent on the size of the real permeability μ', while the noise-absorbing effect is dependent on the size of the imaginary permeability μ".

The noise-suppressing magnetic sheet performs noise absorption utilizing the imaginary part μ" of the complex magnetic permeability of the magnetic material in the frequency band in which noise is generated, and the maximum value of μ" is larger with a larger μ', at low frequency. Such a high magnetic permeability (high μ) sheet can be obtained by high density packing of flat powder with a low coercive force Hc and a large particle size.

The present inventors have conducted diligent research on the relationship between the physical properties and the magnetic permeability μ' (sheet property) of flat powder in a magnetic sheet produced using flat powder obtained by flattening of soft magnetic alloy powder, and the research has shown that a larger value of $D_{50}/(Hc\times BD)$ for the flat powder results in a larger μ' of the magnetic sheet, given a constant fill factor for the magnetic material. Because the Hc value tends to be smaller with a larger flat powder particle size, the inventors believe that using a sufficiently flattened magnetic material with a large particle size is an essential condition for obtaining a magnetic sheet with a high μ.

The flat soft magnetic material of the invention preferably has an aspect ratio of 20 or greater and a $D_{50}$ of 50 μm or greater. By using such a flat soft magnetic material, it is possible to form a noise-suppressing magnetic sheet with even higher magnetic permeability.

The flat soft magnetic material preferably contains an Fe—Si—Al based alloy (hereinafter also referred to as "sendust"). Sendust has sufficiently low coercive force and can therefore further increase the magnetic permeability. In addition, since sendust does not contain expensive metals, it provides the further advantage of cost reduction.

The invention provides a process for production of the aforementioned flat soft magnetic material, which process comprises a heat treatment step in which soft magnetic alloy powder produced by an atomization method is heat treated in an inert atmosphere at 800-1200° C. to obtain heat treated powder, and a flattening step in which the heat treated powder is flattened in the presence of an organic solvent.

The production process described above allows production of a flat soft magnetic material that can be used to form a noise-suppressing magnetic sheet with a sufficiently high magnetic permeability.

According to the production process of the invention, the porosity of the heat treated powder is preferably no greater than 0.15 $m^3/Mg$ and the average crystal grain size is preferably at least 6 μm. By using such heat treated powder it is possible to obtain a flat soft magnetic material with an even smaller Hc value.

In the production process described above, the organic solvent is preferably a C2-4 monohydric alcohol in order to obtain a high yield of flat powder with a large particle size, without using a flattening aid. The alcohol used for flattening will thus be easy to recover and reutilize.

According to the invention it is possible to provide a flat soft magnetic material that can be used to form a noise-suppressing magnetic sheet with sufficiently high magnetic permeability, as well as a process for its production.

DESCRIPTION OF THE PREFERRED EMBODIMENTS

Flat Soft Magnetic Material

Figure 1:
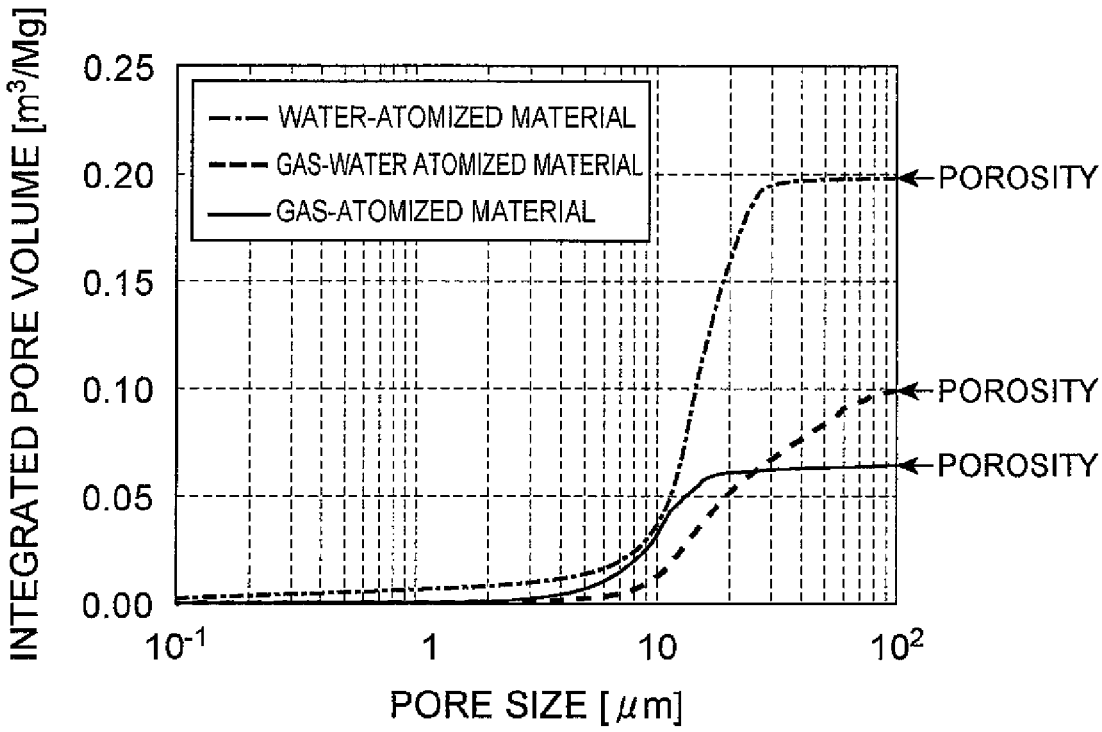
FIG. 1 is a graph showing the results of measurement of a mercury porosimeter for Fe—Si—Al based alloy powder prepared by atomization.

The flat soft magnetic material of this embodiment (hereinafter also referred to as "flat powder") has a 50% particle size $D_{50}$ (μm), coercive force Hc (A/m) and bulk density BD ($Mg/m^3$) that satisfy the following formula (1).

$$D_{50}/(Hc\times BD)\geqq 1.5 \quad (1)$$

The flat soft magnetic material can be produced by flattening soft magnetic alloy powder.

The soft magnetic alloy powder is preferably an alloy with a low coercive force, more preferably an Fe—Si—Al based alloy, known as "sendust" or an Fe—Ni based alloy, known as "permalloy", and even more preferably sendust, since it can result in an even smaller Hc value.

The soft magnetic alloy powder may be produced by a water atomization method, gas atomization method or gas-water atomization method. A water atomization method is a method in which high-pressure water is injected into molten metal of a soft magnetic alloy falling as starting material from a nozzle, for water-cooling to solidify and powderize the soft magnetic alloy. A gas atomization method is a method in which high-pressure gas is injected into molten metal of a soft magnetic alloy falling as starting material from a nozzle, for air-cooling to solidify and powderize the soft magnetic alloy. The gas used may be air or an inert gas, but preferably an inert gas is used for sendust. A gas-water atomization method is a combination of gas atomization and water atomization, in which high-pressure gas is injected into molten metal of a soft magnetic alloy falling as starting material from a nozzle, prior to water-cooling to solidify and powderize the soft magnetic alloy.

According to the invention, it is preferred to use soft magnetic alloy powder produced by a gas atomization or gas-water atomization method, because these allow the porosity to be reduced.

While a larger particle size of the flat powder allows the μ' of the magnetic sheet to be increased given the same fill factor, this also makes high-density packing more difficult and roughens the sheet surface, and therefore the 50% particle size $D_{50}$ of the soft magnetic alloy powder is preferably about 50-100 μm.

The flat soft magnetic material can be produced by a method comprising a heat treatment step in which soft magnetic alloy powder is heat treated in an inert atmosphere at 800-1200° C. to obtain heat treated powder, and a flattening step in which the heat treated powder is flattened in the presence of an organic solvent. This process will now be explained.

(Heat Treatment Step)

As pretreatment prior to flattening of the soft magnetic alloy powder, the soft magnetic alloy powder obtained by different atomization methods is heated treated at a prescribed temperature in an inert atmosphere containing an introduced inert gas such as argon gas, to obtain a heat treated powder.

The heat treatment temperature is 800-1200° C., and more preferably 900-1100° C. Heat treatment in this temperature range can increase the crystal grain size of the soft magnetic alloy powder. If the treatment temperature exceeds 1200° C., the soft magnetic alloy powder will undergo extensive aggregation or sintering, thus hampering the flattening process.

The heat treatment time is preferably about 10 minutes-5 hours and more preferably 1-3 hours. A heat treatment time of less than 10 minutes will not result in a sufficiently large crystal grain size, while a time of greater than 5 hours will not result in any greater crystal grain size and thus lowers productivity.

The porosity of the heat treated powder is preferably no greater than 0.15 $m^3/Mg$, more preferably no greater than 0.10 $m^3/Mg$ and even more preferably no greater than 0.07 $m^3/Mg$. A lower porosity will result in an increased 50% particle size of the soft magnetic material after flattening, thus tending to increase the μ' of the magnetic sheet. The porosity of the heat treated powder can be measured with a mercury porosimeter.

FIG. 1 is a graph showing the measurement results for Fe—Si—Al based alloy powder prepared by different atomization methods, using a mercury porosimeter. As seen in FIG. 1, the porosity of the soft magnetic alloy powder depends on the atomization method, with increasing porosity in the following order: gas atomization<gas-water atomization<water atomization. The change in porosity of the soft magnetic alloy powder due to heat treatment temperature is minimal.

The average crystal grain size of the heat treated powder is preferably at least 6 μm, more preferably at least 8 μm and even more preferably at least 9 μm. A average crystal grain size of less than 6 μm will result in a small 50% particle size of the flat soft magnetic material, thus tending to decrease the μ' of the magnetic sheet. The average crystal grain size is the value determined by image analysis when the soft magnetic alloy powder or heat treated powder is embedded in a resin, mirror-polished and then etched, and photographed with a scanning electron microscope (SEM).

(Flattening Step)

The heat treated powder is then flattened.

The flattening method is not particularly restricted and may be carried out, for example, using an attritor, ball mill, vibrating mill or the like. An attritor is preferably used to allow mixing and pulverization of the starting powder in a shorter time than with a ball mill or vibrating mill. The flattening is preferably carried out in a wet system using an organic solvent.

The organic solvent used may be, for example, toluene, hexane, acetone, methanol or a C2-4 monohydric alcohol. C2-4 monohydric alcohols include ethanol, 1-propanol, 2-propanol, 1-butanol, 2-butanol, isobutanol and t-butanol.

The amount of organic solvent added is preferably 200-2000 parts by weight and more preferably 500-1000 parts by weight with respect to 100 parts by weight of the heat treated powder. If the organic solvent is added at less than 200 parts by weight the particle size of the flat powder will tend to be reduced, and if it is added at greater than 2000 parts by weight the treatment time will be lengthened, thus lowering the productivity.

Even when a friable soft magnetic alloy powder is used, it is possible to obtain a high yield of sufficiently flattened flat powder with a large particle size, by adding the organic solvent. Sendust is easily crushed, and it has been difficult to obtain high yields of sufficiently flattened flat powder with large particle sizes by conventional methods. According to the invention, it is possible to accomplish satisfactory flattening even when using sendust, and to obtain a flat soft magnetic material with a average particle size of 50 μm or greater that is suitable for use in a noise-suppressing magnetic sheet.

A flattening aid may be used together with the organic solvent in order to increase the particle size of the flat powder. Fatty acids such as stearic acid are examples of flattening aids that may be used. The amount of flattening aid added is preferably 0.1-5 parts by weight and more preferably 0.5-2 parts by weight with respect to 100 parts by weight of the heat treated powder. Adding the flattening aid at greater than 5 parts by weight will not further increase the particle size of the flat powder, and will also hamper recovery and reuse of the organic solvent while also increasing contamination of the heat treatment furnace. When a C2-4 monohydric alcohol is used as the organic solvent, a flat powder with a large particle size can be obtained even without adding a flattening aid.

The flattening treatment is preferably followed by heat treatment of the obtained flat soft magnetic material in an inert atmosphere. This will reduce the coercive force Hc and increase the μ' of the magnetic sheet. The heat treatment temperature in this case is 700-900° C. and the treatment time is approximately 10 minutes to 3 hours.

The aspect ratio (=particle size/thickness) of the flat soft magnetic material produced in the manner described above is preferably 20 or greater, more preferably 20-100 and even more preferably 30-50. An aspect ratio of less than 20 will increase the demagnetizing field, thus lowering the apparent magnetic permeability when the material is used as a magnetic sheet, while an aspect ratio of greater than 100 will lower the fill factor (=flat soft magnetic material volume/magnetic sheet volume), thus tending to lower the magnetic permeability.

The 50% particle size $D_{50}$ of the flat soft magnetic material is preferably at least 50 μm, more preferably at least 55 μm and even more preferably at least 60 μm. If the $D_{50}$ is less than 50 μm it will be difficult to obtain flat powder with a small holding power Hc, and the real permeability μ' will tend to be smaller. If $D_{50}$ is too large, mixing of the binder resin will be more difficult and production of the magnetic sheet will be hampered, and therefore the upper limit for $D_{50}$ is about 100 μm. The value of $D_{50}$ throughout the present specification was measured by laser diffraction using a dry dispersion unit, employing a "HELOS SYSTEM" by Japan Laser Corp.

The coercive force Hc of the flat soft magnetic material is preferably no greater than 100 A/m and more preferably no greater than 80 A/m. If Hc exceeds 100 A/m, the μ' value of the magnetic sheet will tend to be smaller. Hc may be measured using a commercially available Hc meter.

The bulk density BD of the flat soft magnetic material is preferably 0.20-0.60 $Mg/m^3$ and more preferably 0.25-0.50 $Mg/m^3$. If BD is less than 0.20 $Mg/m^3$ the fill factor will tend to be lower upon sheeting, while if it is greater than 0.60 $Mg/m^3$ the degree of flattening will be insufficient, thus increasing the demagnetizing field and lowering the apparent magnetic permeability. The BD value can be measured using a bulk specific gravity meter, by the method of JIS K-5101.

The specific surface area SSA of the flat soft magnetic material is preferably no greater than 1.5 $m^2/g$ and more preferably no greater than 1.0 $m^2/g$. If the SSA is greater than 1.5 $m^2/g$, a greater amount of binder resin will be necessary and the fill factor of the magnetic material will tend to be reduced. The SSA value throughout the present specification was measured using a "Macsorb Model-1201" fully automatic specific surface area meter by Mountech Co., Ltd.

The flat soft magnetic material of the invention has $D_{50}$, Hc and BD values satisfying the condition represented by formula (1) above, and the value calculated by $D_{50}/(Hc \times BD)$ is 1.5 ($\mu m/Am^{-1}/Mgm^{-3}$) or greater, preferably 2.0 or greater and even more preferably 3.0 or greater.

Figure 2:
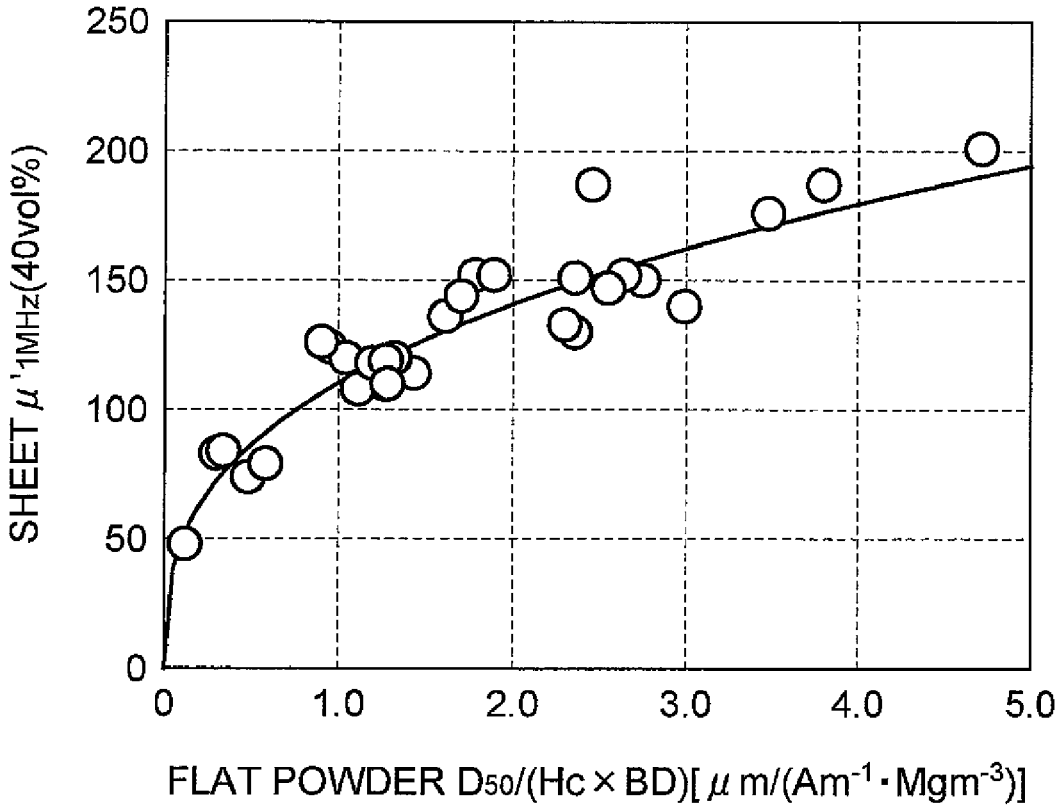
FIG. 2 is a graph showing the relationship between $D_{50}$/(Hc×BD) for the flat soft magnetic material and μ' for the magnetic sheet.

FIG. 2 is a graph showing the relationship between $D_{50}/(Hc \times BD)$ for the flat soft magnetic material and μ' for the magnetic sheet. A noise-suppressing magnetic sheet generally performs noise absorption utilizing the imaginary part μ" of the complex magnetic permeability of the magnetic material in the frequency band in which noise is generated, and maximum value of μ" is larger with a larger μ' at low frequency. The power of the noise-suppressing sheet can therefore be evaluated based on the size of the value of μ'. A magnetic sheet with a large value for μ' can be obtained by high density packing of flat powder with a low coercive force and a large 50% particle size. When the fill factor of the flat powder in the magnetic sheet is constant, a larger value represented by $D_{50}/(Hc \times BD)$ corresponds to a larger μ' value for the flat powder, so that a more excellent noise-suppressing effect is obtained.

If $D_{50}/(Hc \times BD)$ is less than 1.5, therefore, the μ' value of the magnetic sheet will be smaller and the noise-suppressing effect may be inadequate.

<Noise-Suppressing Magnetic Sheet>

A magnetic sheet may be formed using the flat soft magnetic material described above. There are no particular restrictions on the method of forming the magnetic sheet, and the following is an example.

The flat soft magnetic material and binder resin may be kneaded together and subjected to press molding or extrusion molding to form a sheet. Alternatively, the flat soft magnetic material and binder resin may be dispersed in an organic solvent to produce a slurry, and the slurry cast as a film to a prescribed thickness on a support base by doctor blading and then dried and rolled with a calender roll to form a sheet.

The thickness of the magnetic sheet will be about 0.05-2 mm. Since the noise-suppressing effect is proportional to the thickness of the magnetic sheet, it will be difficult to obtain a satisfactory effect if the thickness of the magnetic sheet is less than 0.05 mm. On the other hand, a magnetic sheet thickness of greater than 2 mm will result in more difficult loading into the narrow spaces inside the packages of electrical equipment.

The fill factor of the flat soft magnetic material in the magnetic sheet is preferably 30-60 vol % and more preferably 40-50 vol %. A fill factor of less than 30 vol % will result in a lower noise-suppressing effect, while a fill factor of greater than 60 wt % will prevent the soft magnetic material from being firmly bound by the binder resin, thus lowering the magnetic sheet strength.

The binder resin is an insulating resin for bonding of the flat soft magnetic material. All or a portion of the surface of the flat soft magnetic material is coated with the binder resin. As examples of binder resins there may be mentioned polyester-based resins, polyethylene resins, polyvinyl chloride-based resins, polyvinyl butyral resins, polyurethane resins, cellulose-based resins, ABS resins, nitrile-butadiene-based rubbers, styrene-butadiene-based rubbers, epoxy resins, phenol resins and amide-based resins.

The amount of binder resin added is preferably 10-40 parts by weight and more preferably 15-25 parts by weight with respect to 100 parts by weight of the flat soft magnetic material.

The magnetic sheet may further contain a plasticizer, curing agent, dispersing agent, stabilizer, coupling agent, diluent or the like if necessary in addition to the flat soft magnetic material and binder resin.

When the magnetic sheet has been molded or coated into the prescribed shape, an oriented magnetic field may be applied or the material may be mechanically oriented to obtain a magnetic sheet with a high directional property.

In order to obtain a sufficiently high noise-suppressing effect, the μ' of the noise-suppressing magnetic sheet is preferably 130 or greater and more preferably 150 or greater.

The magnetic sheet formed in the manner described above has high magnetic permeability and is therefore highly useful as a noise-suppressing magnetic sheet.

The present invention is not in any way limited to the preferred modes described above.

EXAMPLES

The present invention will now be explained in detail by examples, with the understanding that the invention is not limited to the examples.

Examples 1-6 and Comparative Examples 1-6

Fe—Si—Al (Si=8-11 wt %, Al=5-7 wt %) based alloy powders (sendust powders) produced by different atomization methods, as shown in Table 1, were prepared and treated at 700-1300° C. for 2 hours in an Ar atmosphere to obtain heat treated powders. The porosity of the heat treated powders was measured using a mercury porosimeter ("Porosimeter Model PASCAL140/440, trade name of CE Instruments). The average crystal grain size of the soft magnetic alloy powder was determined by image analysis of an SEM photograph, as described above.

Next, a 5.7-fold amount of toluene by weight and 1 wt % stearic acid as a flattening aid were added to the untreated or heat treated powder, and an attritor was used for flattening to obtain flat powder. The flattening time was adjusted for a bulk density BD of approximately 0.4 $Mg/m^3$. The bulk density of the flat powder was measured using a bulk specific gravity meter (measuring sample: 30 ml), according to JIS K-5101. The particle size distribution of the flat powder was measured by a laser method ("HELOS SYSTEM", trade name of Japan Laser Corp.). The flat powder was then heat treated at 800° C. for 2 hours in an Ar atmosphere. The coercive force Hc of the flat powder after heat treatment was measured using an Hc meter ("K-HC1000", trade name of Tohoku Steel Co., Ltd.).

A slurry was prepared by mixing 100 parts by weight of the obtained flat powder, 17 parts by weight of a binder resin (polyvinyl butyral), 2 parts by weight of a plasticizer (diethyl phthalate), and 150 parts by weight of a diluent (mixing solvent comprising toluene, xylene, 1-propanol and SOLMIX (trade name of Japan Alcohol Trading Co., Ltd.). The slurry was coated onto a PET film and passed through a magnetic field with opposing like poles, for magnetic field orientation to form a magnetic sheet layer. After drying, the magnetic sheet layer was peeled from the PET film, and 6 layers were hot pressed at 90° C., 77 MPa for 1 hour to produce a magnetic sheet.

(Evaluation of Magnetic Sheet)

The magnetic sheet was punched out into a toroidal shape using a die with an outer diameter of 18 mm and an inner diameter of 10 mm, and an impedance analyzer ("E4991A", trade name of Agilent Technologies) was used to evaluate the magnetic properties.

Table 1 shows the starting materials, flat powders and magnetic sheet properties (where the μ' values of the magnetic sheets are calculated for a magnetic material fill factor of 40 vol %).

TABLE 1

| | Starting material properties | | Heat-treated powder properties: Heat treatment | | Average crystal | Flat powder properties | | | | | | Sheet property μ' |
|---|---|---|---|---|---|---|---|---|---|---|---|---|
| | Atomization method | $D_{50}$ μm | temperature ° C. | Porosity $m^3/Mg$ | grain size μm | Aspect ratio | $D_{50}$ μm | BD $Mg/m^3$ | Hc A/m | D50/(Hc × BD) μm/Am − 1/$Mgm^{-3}$ | SSA $m^2/g$ | 1 MHz (40 vol %) |
| Example 1 | Gas-water | 83 | 800 | 0.117 | 6.6 | 29 | 57 | 0.39 | 91 | 1.6 | 0.89 | 136 |
| Example 2 | atomization | | 900 | 0.104 | 9.5 | 31 | 62 | 0.4 | 87 | 1.8 | 0.87 | 152 |
| Example 3 | | | 1000 | 0.11 | 10.2 | 34 | 66 | 0.4 | 70 | 2.4 | 0.74 | 151 |
| Example 4 | | | 1100 | 0.131 | 13.6 | 32 | 65 | 0.41 | 84 | 1.9 | 0.75 | 152 |
| Example 5 | | | 1200 | 0.116 | 15.3 | 32 | 65 | 0.41 | 93 | 1.7 | 0.95 | 144 |
| Example 6 | Gas atomization | 59 | 1000 | 0.061 | 9.3 | 35 | 69 | 0.39 | 72 | 2.5 | 0.65 | 187 |
| Comp. Ex. 1 | Water | 55 | None | 0.199 | 3.7 | 14 | 29 | 0.42 | 231 | 0.3 | 1.37 | 83 |
| Comp. Ex. 2 | atomization | | 1000 | 0.192 | 5 | 16 | 30 | 0.37 | 239 | 0.34 | 1.35 | 84 |
| Comp. Ex. 3 | Gas-water | 83 | None | 0.102 | 3.9 | 22 | 46 | 0.42 | 115 | 0.95 | 1.01 | 124 |
| Comp. Ex. 4 | atomization | | 700 | 0.1 | 3.4 | 23 | 45 | 0.39 | 111 | 1 | 1.05 | 120 |
| Comp. Ex. 5 | | | 1300 | —** | —** | **Unusable due to sintering | | | | | | — |
| Comp. Ex. 6 | Gas atomization | 59 | None | 0.065 | 5.4 | 22 | 39 | 0.35 | 124 | 0.9 | 1.58 | 126 |

In Examples 1-6, the sendust powder prepared by gas atomization or gas-water atomization was heat treated at 800-1200° C. to obtain flat powder with a $D_{50}$ of 50 μm or greater, and the $D_{50}$/(Hc×BD) value was 1.5 or greater. The magnetic sheets formed using these flat powders were confirmed to have a μ' of 130 or greater and sufficiently high magnetic permeability. In Comparative Examples 1-4 and 6, however, the $D_{50}$ of the obtained flat powder was less than 50 μm, the $D_{50}$/(Hc×BD) value was less than 1.5, and the μ' of the sheet was less than 130. In Comparative Example 5, the heat treatment carried out at 1300° C. caused sintering and prevented flattening.

Examples 7-11 and Comparative Examples 7-11

Fe—Si—Al (Si=8-11 wt %, Al=5-7 wt %) based alloys produced by different atomization methods, as shown in Table 2, were prepared and treated at 700-1100° C. for 2 hours in an Ar atmosphere to obtain heat treated powders. Next, a 5.7-fold amount of 2-propanol by weight was added to the untreated or heat treated powder, without using a flattening aid, and an attritor was used for flattening to obtain flat powder. The flattening time was adjusted for a BD of approximately 0.2-0.3 $Mg/m^3$. The rest of the treatment and evaluation were carried out in the same manner as Example 1.

TABLE 2

| | Starting material properties | | Heat-treated powder properties: Heat treatment | | Average crystal | Flat powder properties | | | | | | Sheet property μ' |
|---|---|---|---|---|---|---|---|---|---|---|---|---|
| | Atomization method | $D_{50}$ μm | temperature ° C. | Porosity $m^3/Mg$ | grain size μm | Aspect ratio | $D_{50}$ μm | BD $Mg/m^3$ | Hc A/m | D50/(Hc × BD) μm/Am − 1/$Mgm^{-3}$ | SSA $m^2/g$ | 1 MHz (40 vol %) |
| Example 7 | Gas-water atomi-zation | 83 | 1000 | 0.11 | 10.2 | 31 | 53 | 0.32 | 72 | 2.3 | 0.79 | 133 |
| Example 8 | Gas | 59 | 800 | 0.062 | 6.4 | 33 | 50 | 0.26 | 70 | 2.7 | 0.9 | 150 |
| Example 9 | atomization | | 900 | 0.069 | 7.7 | 37 | 53 | 0.25 | 61 | 3.5 | 0.82 | 176 |
| Example 10 | | | 1000 | 0.061 | 9.3 | 40 | 58 | 0.25 | 61 | 3.8 | 0.76 | 187 |
| Example 11 | | | 1100 | 0.066 | 12.5 | 47 | 65 | 0.23 | 60 | 4.7 | 0.82 | 201 |
| Comp. Ex. 7 | Water | 55 | None | 0.199 | 3.7 | 19 | 30 | 0.29 | 215 | 0.48 | 1.38 | 74 |
| Comp. Ex. 8 | atomization | | 1000 | 0.192 | 5 | 20 | 32 | 0.28 | 196 | 0.58 | 1.24 | 79 |
| Comp. Ex. 9 | Gas-water atomization | 83 | None | 0.102 | 3.9 | 24 | 39 | 0.29 | 107 | 1.3 | 0.95 | 110 |
| Comp. Ex. 10 | Gas | 59 | None | 0.065 | 5.4 | 23 | 34 | 0.25 | 95 | 1.4 | 0.97 | 114 |
| Comp. Ex. 11 | atomization | | 700 | 0.064 | 5.6 | 22 | 32 | 0.25 | 97 | 1.3 | 1.01 | 120 |

In Examples 7-11, flat powder with a $D_{50}$ of 50 μm or greater and a $D_{50}$/(Hc×BD) value of 1.5 or greater were obtained, and using the different flat powders produced magnetic sheets with sufficiently high magnetic permeability (μ' of 130 or greater). In Comparative Examples 7-11, however, the $D_{50}$ of the obtained flat powder was only less than 50 μm, the $D_{50}$/(Hc×BD) value was less than 1.5, and the μ' of the produced magnetic sheet was 120 or smaller.

Examples 12-15 and Comparative Examples 12-16

Fe—Si—Al (Si=8-11 wt %, Al=5-7 wt %) based alloys produced by gas-water atomization, as shown in Table 3, were prepared and treated at 1000° C. for 2 hours in an Ar atmosphere to obtain heat treated powders. Next, a 5.7-fold amount by weight of each of the flattening solvents shown in Table 3 was added to the heat treated powder, without using a flattening aid, and an attritor was used for flattening to obtain flat powder. The flattening time was adjusted for a BD of approximately 0.2-0.3 $Mg/m^3$. The rest of the treatment and evaluation were carried out in the same manner as Example 1.

TABLE 3

| | Starting material properties | Heat-treated powder properties | | | Flat powder properties | | | | | | | Sheet property |
|---|---|---|---|---|---|---|---|---|---|---|---|---|
| | | Heat treatment | | Average crystal | | | | | | | | μ' |
| | $D_{50}$ μm | temperatur ° C. | Porosity $m^3/Mg$ | grain size μm | Flattening solvent | Aspect ratio | $D_{50}$ μm | BD $Mg/m^3$ | Hc A/m | D50/(Hc × BD) μm/Am − 1/$Mgm^{-3}$ | SSA $m^2/g$ | 1 MHz (40 vol %) |
| Example 12 | 83 | 1000 | 0.11 | 10.2 | Ethanol | 36 | 54 | 0.26 | 88 | 2.4 | 0.88 | 130 |
| Example 13 | | | | | 1-Propanol | 39 | 59 | 0.26 | 76 | 3 | 0.9 | 140 |
| Example 14 | | | | | 1-Butanol | 41 | 57 | 0.23 | 94 | 2.6 | 1.26 | 152 |
| Example 15 | | | | | Isobutanol | 35 | 55 | 0.28 | 77 | 2.6 | 0.97 | 147 |
| Comp. Ex. 12 | 83 | 1000 | 0.11 | 10.2 | Hexane | 26 | 39 | 0.26 | 135 | 1.1 | 0.97 | 108 |
| Comp. Ex. 13 | | | | | Toluene | 24 | 37 | 0.27 | 115 | 1.2 | 0.94 | 118 |
| Comp. Ex. 14 | | | | | Acetone | 27 | 41 | 0.26 | 124 | 1.3 | 1.04 | 119 |
| Comp. Ex. 15 | | | | | Water | 10 | 17 | 0.33 | 419 | 0.12 | 11.95 | 48 |
| Comp. Ex. 16 | | | | | Methanol | 29 | 42 | 0.25 | 131 | 1.3 | 3.24 | 110 |

Based on Examples 7 and 12-15, using a C2-4 monohydric alcohol as the flattening solvent resulted in a $D_{50}$ of 50 μm or greater for the flat powder without using a flattening aid, while also satisfying the condition of a $D_{50}$/(Hc×BD) value of 1.5 or greater, and magnetic sheets with sufficiently high magnetic permeability (μ' of 130 or greater) were obtained. However, in Comparative Examples 12-16 which employed other flattening solvents, the $D_{50}$ of the flat powder was less than 50 μm, the $D_{50}$/(Hc×BD) value was less than 1.5 and the μ' of the sheet was less than 130.

Examples 16 and 17 and Comparative Examples 17 and 18

Mo-permalloy ((Ni=79, Mo=4 wt %) alloy powders produced by water atomization, as shown in Table 4, were prepared and treated at 900° C. for 1 hour in an Ar atmosphere to obtain heat treated powders. Next, a 5.7-fold amount by weight of toluene was added to the heat treated powder, without using a flattening aid, and an attritor was used for flattening to obtain flat powder. The rest of the treatment and evaluation were carried out in the same manner as Example 1.

TABLE 4

| | Flat powder properties | | | | | | Sheet property |
|---|---|---|---|---|---|---|---|
| | Aspect ratio | $D_{50}$ μm | BD $mg/m^3$ | Hc A/m | $D_{50}$/(Hc × BD) μm/$Am^{-1}$/$mgm^{-3}$ | SSA $m^2/g$ | $\mu'_{1\,MHz}$ (40 vol %) |
| Example 16 | 43 | 83 | 0.49 | 83 | 2.0 | 0.58 | 140 |
| Example 17 | 60 | 98 | 0.38 | 82 | 3.1 | 0.49 | 165 |
| Comp. Ex. 17 | 12 | 32 | 0.75 | 112 | 0.38 | 1.18 | 88 |
| Comp. Ex. 18 | 30 | 65 | 0.59 | 100 | 1.1 | 0.96 | 106 |

Based on Examples 16 and 17, using permalloys for flattening resulted in a $D_{50}$/(Hc×BD) value of at least 1.5, to obtain magnetic sheets with sufficiently high magnetic permeability.

What is claimed is:

1. A flat soft magnetic material to be used in a magnetic sheet, wherein the 50% particle size $D_{50}$ (μm), coercive force Hc (A/m) and bulk density BD ($Mg/m^3$) of the flat soft magnetic material satisfy the following formula (1), $$D_{50}/(Hc\times BD)\geqq 1.5 \quad (1)$$

wherein an aspect ratio is 20 or greater and the $D_{50}$ is 50 μm or greater; and the flat soft magnetic material containing a Fe—Si—Al based alloy or Fe—Ni based alloy.

2. A process for production of a flat soft magnetic material according to claim 1, comprising a heat treatment step in which soft magnetic alloy powder produced by an atomization method is heat treated in an inert atmosphere at 800-1200° C. to obtain heat treated powder, and a flattening step in which the heat treated powder is flattened in the presence of an organic solvent.

3. A process for production of a flat soft magnetic material according to claim 2, wherein the porosity of the heat treated powder is no greater than 0.15 $m^3/Mg$ and the average crystal grain size is at least 6 μm.

4. A process for production of a flat soft magnetic material according to claim 2, wherein the organic solvent is a C2-4 monohydric alcohol.

* * * * *